US008745765B1

(12) United States Patent
Ahlborn

(10) Patent No.: US 8,745,765 B1
(45) Date of Patent: Jun. 10, 2014

(54) CHAINSAW PROTECTIVE CHAPS

(71) Applicant: Tracey B. Ahlborn, Sayner, WI (US)

(72) Inventor: Tracey B. Ahlborn, Sayner, WI (US)

(73) Assignee: Ahlborn Equipment, Inc., Sayner, WI (US)

( * ) Notice: Subject to any disclaimer, the term of this patent is extended or adjusted under 35 U.S.C. 154(b) by 0 days.

(21) Appl. No.: 13/762,851

(22) Filed: Feb. 8, 2013

(51) Int. Cl.
*A41D 13/00* (2006.01)

(52) U.S. Cl.
USPC ..... 2/22

(58) Field of Classification Search
USPC ..... 2/22, 24, 46, 51, 242, 455, 79, 227, 2/232, 911
See application file for complete search history.

(56) References Cited

U.S. PATENT DOCUMENTS

| | | | | |
|---|---|---|---|---|
| 5,033,124 | A | 7/1991 | Bucalo et al. | |
| 5,033,126 | A * | 7/1991 | Wruck et al. | 2/242 |
| 5,170,503 | A * | 12/1992 | Hightower et al. | 2/22 |
| 6,065,151 | A | 5/2000 | Conine, III | |
| 6,405,383 | B2 | 6/2002 | Heller et al. | |
| 7,069,670 | B1 * | 7/2006 | Gerke | 36/2 R |
| 7,152,246 | B2 * | 12/2006 | Infante | 2/22 |
| 7,735,151 | B1 * | 6/2010 | Young et al. | 2/96 |
| 7,832,022 | B1 * | 11/2010 | Peters | 2/227 |
| 2008/0155863 | A1 | 7/2008 | Shor et al. | |
| 2008/0216203 | A1 | 9/2008 | Duncan | |
| 2010/0005559 | A1 | 1/2010 | Majerfeld | |

* cited by examiner

*Primary Examiner* — Tejash Patel
(74) *Attorney, Agent, or Firm* — Andrus Intellectual Property Law, LLP

(57) ABSTRACT

Protective chaps to provide protection against chainsaw cuts and, optionally, poisonous snake bites has a woven cloth-like shell lined by a layer of polyester/aramid fiber and, optionally, a partial layer of a woven material, all enclosed by an inside thin polyester fabric. The combination of zippers and hook-and-loop fasteners provides a dual fastener system that protects against freeze up and clogging of exposed zippers and may include alternate connections to provide two different tubular leg sizes.

17 Claims, 5 Drawing Sheets

CHAINSAW PROTECTIVE CHAPS

BACKGROUND

The present invention pertains to protective chaps of a pant-like construction to cover the legs of a wearer. More particularly, the chaps provide protection against a chainsaw cut or, optionally, the bite of a poisonous snake, but typically not both.

Protective chaps for use in the forestry industry are typically made from a heavy woven cloth-like shell such as, for example, Cordura™. This material has inherent protective quality against chainsaw cuts by virtue of its tough construction. In addition, however, the outer shell material is often covered, on the inside face, with another chainsaw protective layer, for example, a polyester/aramid fiber. Snake bite protective chaps, on the other hand, more typically utilize a second inner layer of material similar to the outer shell, but lighter.

Prior art chaps are intended to be worn over the user's pants and, because of the heavy-duty shell material, may be somewhat bulky and difficult to put on either before or after the user puts on boots. Also typically, the chaps are made from generally rectangular leg panels which are folded around the user's legs and connected by their inner edges to form a generally tubular leg. The opposite vertical edges of the leg panel are connected with different types of fasteners including straps and buckles, and hook-and-loop fasteners. When using straps and buckles, adjustable fitting can be attained, but the fastener straps are unwieldy, have loose ends, and result in potential hazards possibly causing the user to trip and fall. Also, the opposite vertical edges of the panel typically extend from the bottom edge only a portion of the distance to the upper edge, resulting in added difficulty in the user slipping a leg into the closed upper tubular leg portion, especially over boots.

Because loggers and other forestry workers often work in areas inhabited by poisonous snakes, there is a need for material or materials that address both chainsaw cut and snake bite hazards. However, adding a completely separate layer of protective material can add to the bulkiness and difficulty in handling the heavier chaps. In a typical pair of prior art chaps, using straps and buckles to close the legs, the connecting buckles are exposed and may become clogged with snow, ice or other materials. If zippers are used instead of buckles, the problem may be even worst with the zippers becoming clogged and frozen and difficult to use.

SUMMARY OF THE INVENTION

In accordance with the present invention, a protective leg chap includes a pair of leg assemblies each having an outer cloth shell with the shells connected to one another by an upper rear support section. Each leg assembly includes a leg panel of generally rectangular shape and having opposite, substantially parallel edges when the leg panel is open and flat. The legs include an open-and-closed arrangement that extends substantially the full length of the edges and defines a tubular leg when the leg panel edges are overlapped and connected. The open-and-close arrangement has a first closure half that extends along one panel edge, the first closure half defined by a first half of one type of fastener and a first half of a different type of fastener. A second closure half extends along the other panel edge and has the second closure half that is defined by a second half of said one type of fastener and a second half of said different type of fastener. The first and second halves of said one type of fastener and the first and second halves of said different type of fastener are positioned such that, when the one type of fastener is closed, the first half of said different type of fastener attaches to the second half of the different type of fastener and covers and encloses said one type of fastener.

Preferably, the one type of fastener is a zipper and the different type of fastener is a hook-and-loop fastener. The first halves of said one type of fastener and the different type of fastener comprise a pair of parallel strips, the second halves of said one type of fastener and the different type of fastener each comprise a pair of parallel strips.

The first half of the zipper and the first half of the hook-and-loop fastener are positioned along one panel edge on the inside thereof, and a second half of the zipper and the second half of the hook-and-loop fastener are positioned along the other panel edge on the outside of the leg panel when the panel edges are overlapped. Preferably, the second closure half comprises a pair of parallel spaced zipper strips and a pair of parallel spaced hook-and-loop fastener strips. The respective pairs of a second zipper strip and a second hook-and-loop fastener strip are selectively attachable to the first halves of the zipper and the hook-and-loop fastener on said one panel edge, thereby permitting tubular leg size adjustment.

In a preferred embodiment, the outer cloth shell is covered on an inside surface with a thin polyester fabric. A chainsaw protective layer of polyester/aramid fiber is positioned between the shell and the polyester fabric. Also, a lower portion of the inside surface of the leg panel may be provided with a snake bite protective layer. The snake bite protective layer may comprise a woven material.

In a basic embodiment of the present invention, a protective leg chap includes a leg, assembly made from an outer cloth shell and including a leg panel of generally rectangular shape defined by opposite edges when the leg panel is open and flat. A leg fastener arrangement extends substantially the full length of the panel edges and defines a tubular leg when the leg panel edges are overlapped, connected and closed. The open-and-close fastener arrangement includes a first closure half that extends along one panel edge and includes a first half of a zipper and a first half of a hook-and-loop fastener. A second closure half extends along the other panel edge and includes a second half of said zipper and a second half of said hook-and-loop fastener. The first and second halves of the zipper and the first and second halves of the hook-and-loop fastener are all of generally the same length or coextensive and are positioned such that when the zipper is closed the first half of the hook-and-loop fastener attaches to the second half of said hook-and-loop fastener and encloses the zipper.

The leg chap typically comprises a pair of leg assemblies that are connected to one another by an upper rear support section. The overlying layer of a chainsaw protective material and, optionally, a snake bite protective material, are applied to the inside surface of the outer shell and covered by the thin polyester fabric layer.

DETAILED DESCRIPTION OF THE PREFERRED EMBODIMENT

Figure 5:
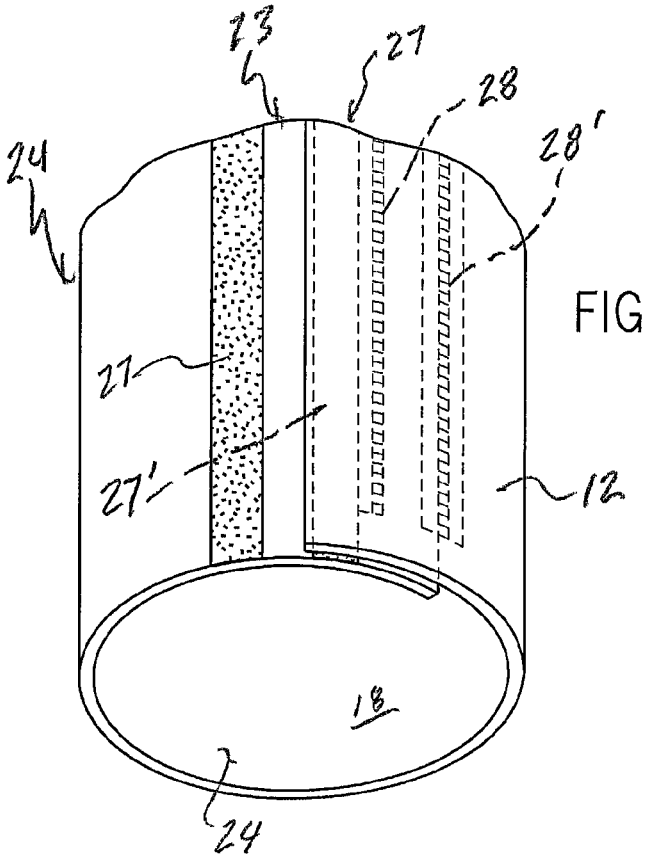
FIG. 5 is a perspective view of the tubular leg panel of FIG. 3 in its final tubular shape for a larger of two tubular legs.
Figure 6:
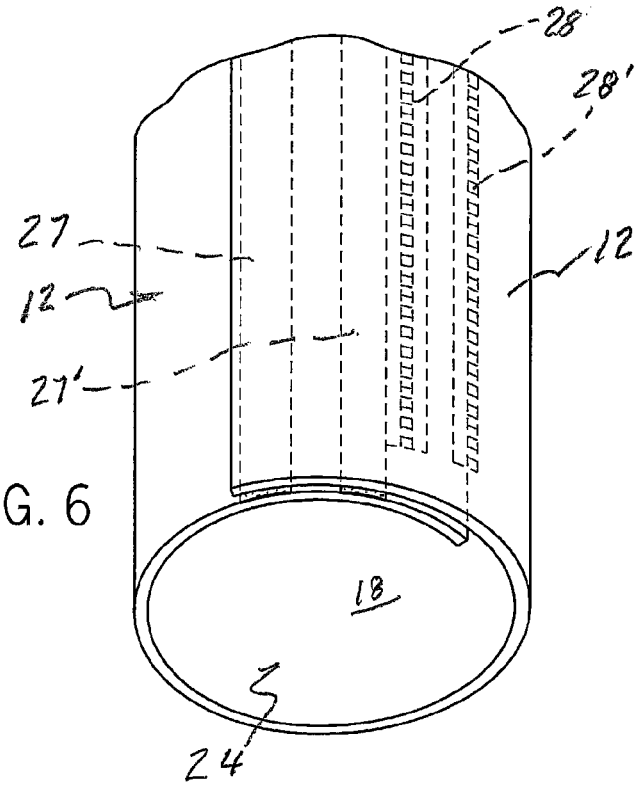
FIG. 6 is a view similar to FIG. 5 showing the tubular leg panel of FIG. 4 in the smaller of the two alternate tubular sizes.
Figure 7:
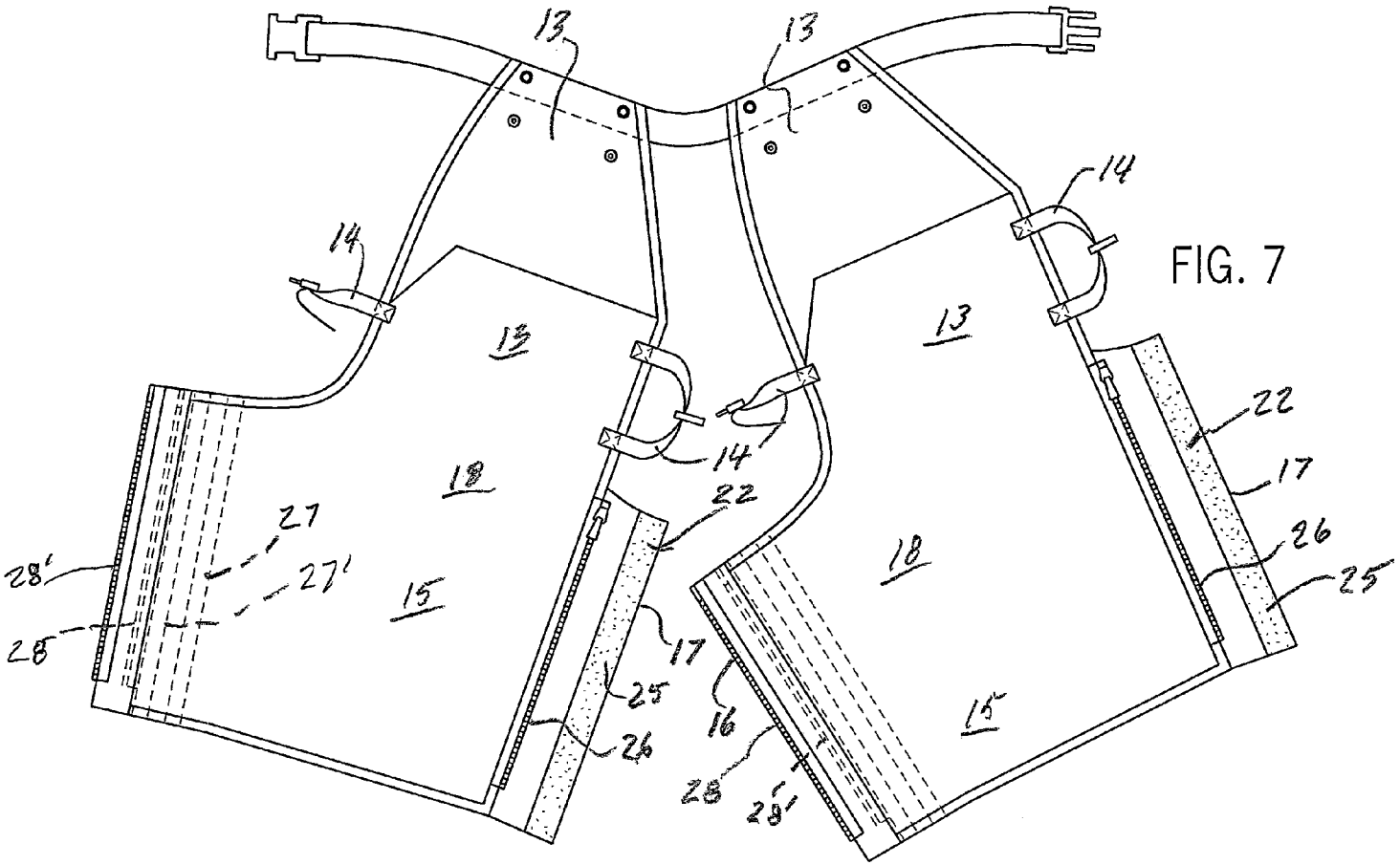
FIG. 7 is a generalized plan view of a pair of interconnected chap assemblies showing the inner cloth shell faces.

FIGS. 1-6 show portions of one chap leg assembly 11 comprising half of a pair of chaps 10. Each leg assembly 11 is connected to another leg assembly to form a pair of chaps 10 as shown in FIG. 7. The leg assemblies 11 are connected by an upper rear support section 13 using adjustable straps 14 to hold the chaps 10 as they are wrapped around the user's waist.

Figure 1:
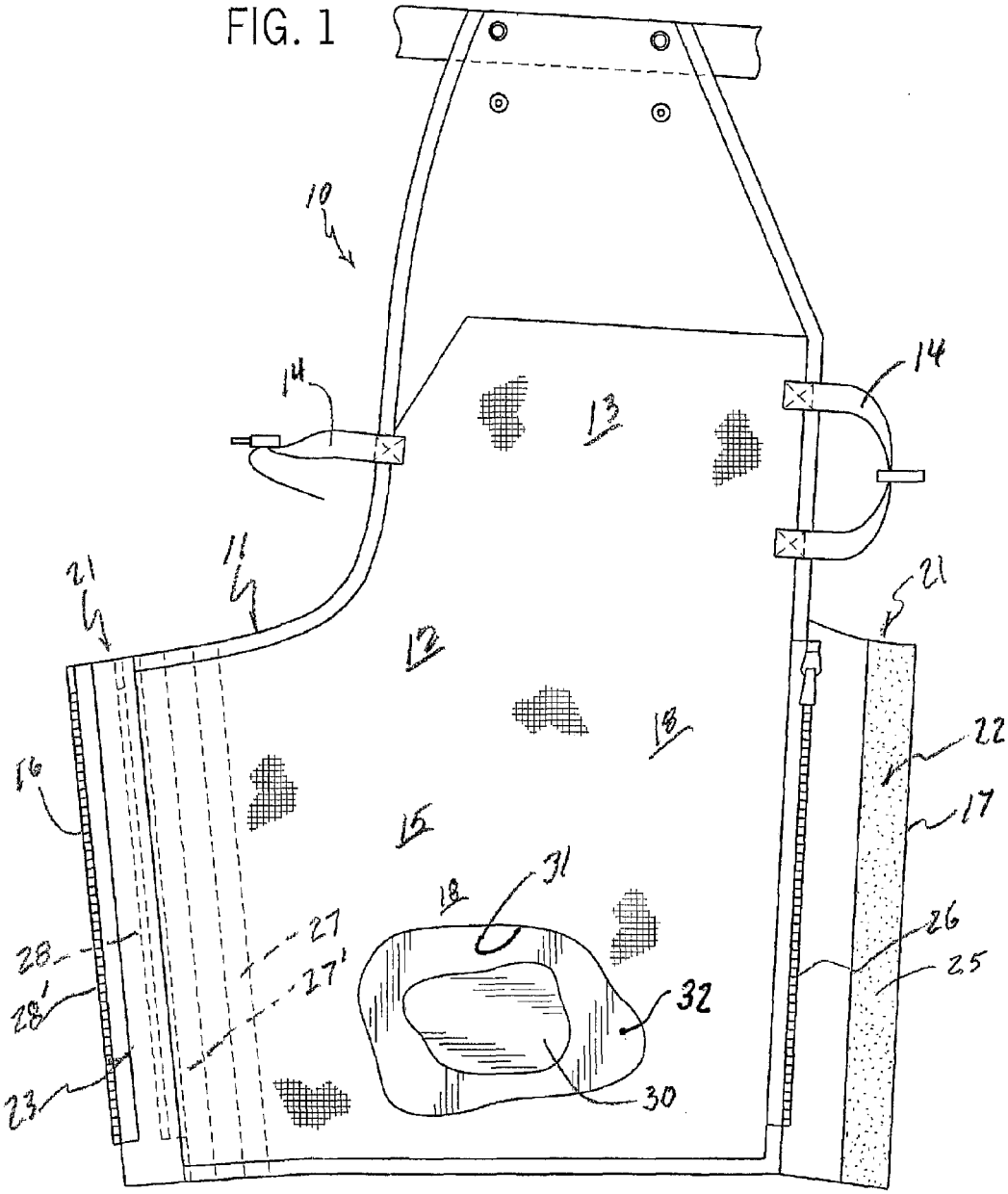
FIG. 1 is a plan view of the outer surface of a leg panel showing the panel open and flat and the layered lining shown broken away.
Figure 2:
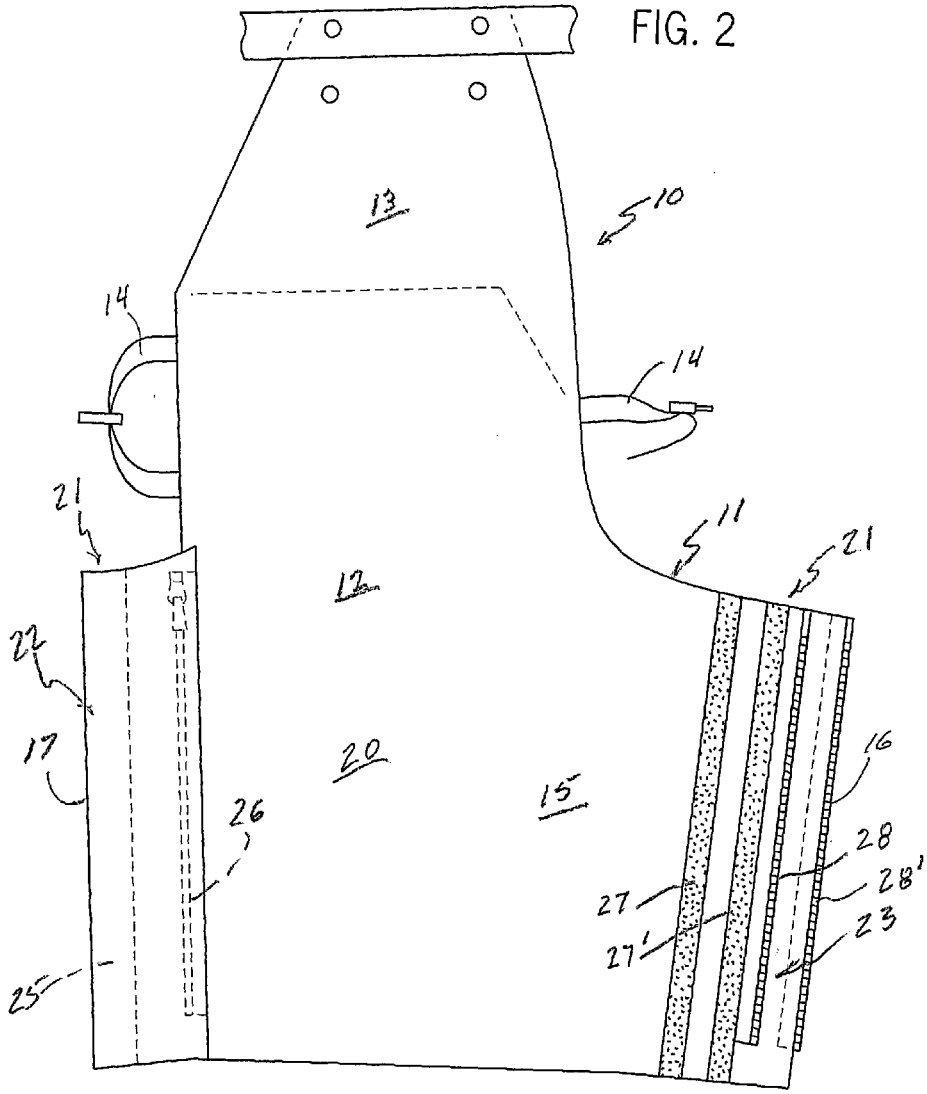
FIG. 2 is a plan view of the panel in FIG. 1 showing the inner panel face.

Each of the leg assemblies 11 has an outer cloth shell 12 that extends vertically from the lower edge of the leg assembly and is formed of a heavy woven material, such as Cordura™, as is well known in the industry. Each leg assembly includes a leg panel 15, that is rectangular in shape and includes opposite vertical edges 16 and 17 when the leg panel 15 is open and flat. The outside face 18 of the leg panel is shown in FIG. 1 and the inside face 20 of the panel is shown in FIG. 2.

Leg panel 15 is folded over to bring the vertical edge 16 toward the opposite vertical edge 17 which is folded toward edge 16 until the edges 16 and 17 overlap and are closed with closing arrangement in accordance with the present invention.

The leg assemblies 11 for a pair of leg chaps are identical and are connected to the upper support sections 13 with the adjustable pairs of waist straps 14. In FIG. 2, there is shown the inside face 20 of the leg panel 15. On one edge of the inside face 20, there is shown the tint half 22 of the closing arrangement 21 of the present invention. The first half 22 extends substantially the full length of vertical edge 17 and, when connected to the second half of the closing arrangement 21, connection of first vertical edge 16 to the second vertical edge 17 on the opposite edge of the leg panel 15, the closing arrangement defines a tubular leg 24 which is shown in FIGS. 5 and 6 in the two size connection of overlaps of panel edges 16 and 17.

Figure 3:
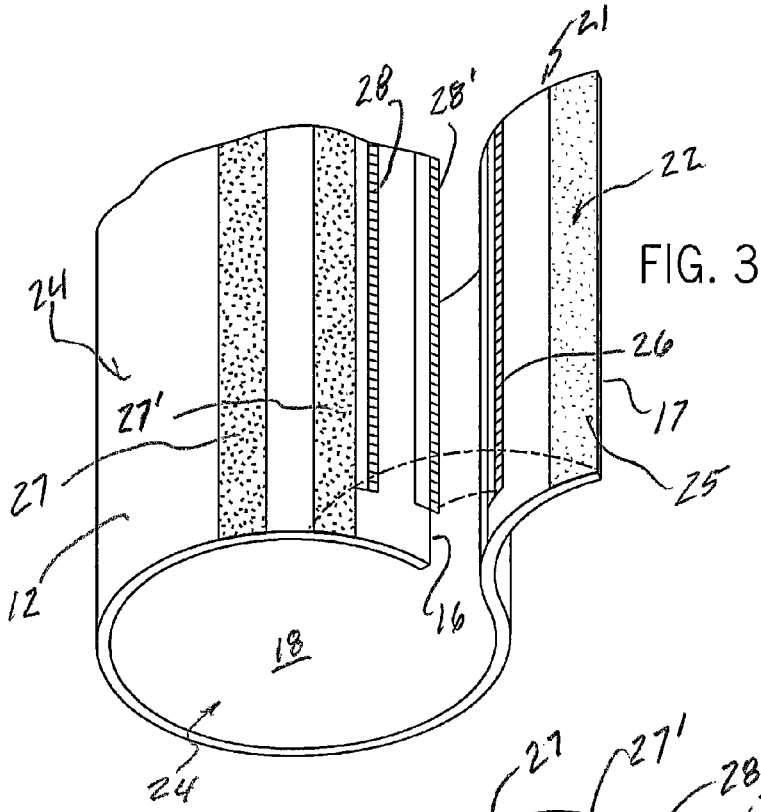
FIG. 3 is a view of the leg panel with the left edge of the panel being folded over toward the right edge to form a larger diameter tubular leg.
Figure 4:
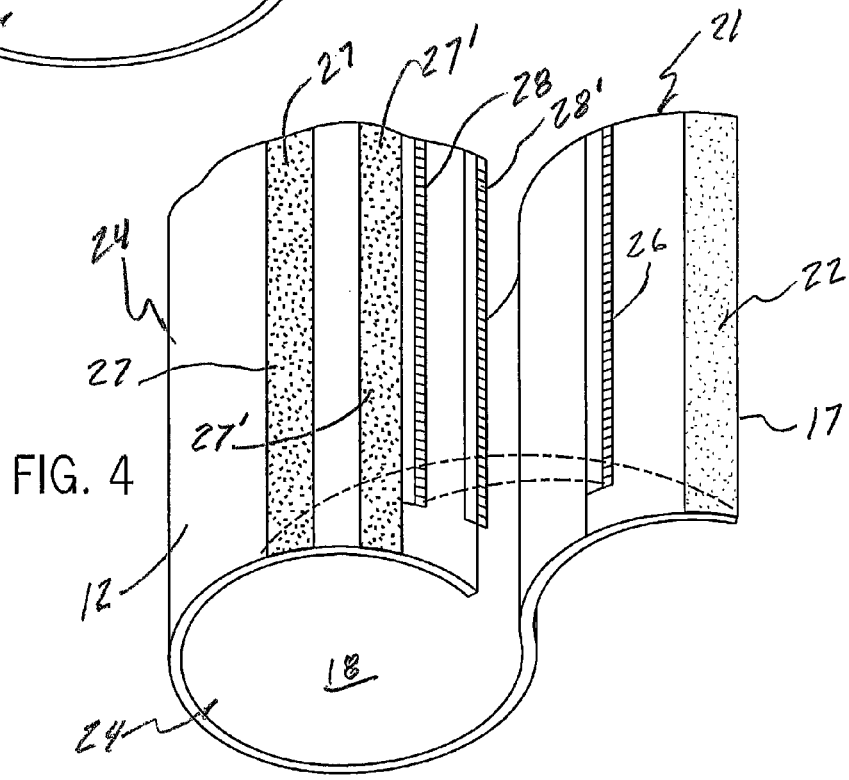
FIG. 4 is a plan view similar to FIG. 3 showing the left edge of the panel folded further over to the right edge to form a smaller diameter tubular leg.

The first half 22 of the closing arrangement includes half of a first hook-and-loop fastener strip 25 attached at the edge 17 and the first half of a zipper 26 attached parallel to and spaced from the first hook-and-loop strip 25. The second half 23 of the closing arrangement 21 is shown in the plan view of FIG. 2 and is also shown in phantom in the opposite plan view of FIG. 1. The second half 23 of the closing arrangement 21 includes alternate pairs of a second half of a hook-and-loop fastener 27, 27' and alternate pairs of second zipper strips 28, 28'. The alternate pairs of second hook-and-loop fastener strips 27, 27' and corresponding alternate second zipper strips 28, 28' permit circumferential size adjustment of the tubular leg 24 of the leg panel 15. Referring to FIGS. 1 and 2, when the first half 22 along edge 17 is folded over toward the second half 23 positioned along vertical edge 16, the first half 22 of the closing arrangement 21 (comprising first hook-and-loop fastener strip 25 and first zipper strip 26), the first zipper strip 26 and the first hook-and-loop fastener strip 25 may be selectively and respectively attached to a pair of a second hook-and-loop fastener strip 27 and a second zipper strip 28 or second hook-and-loop fastener strip 27' and second zipper strip 28'. In forming the tubular leg 24, as shown in FIGS. 3 and 4, the first zipper strip 26 is connected to either of the second zipper strips 28, 28', and the first hook-and-loop fastener strip 25 is correspondingly attached either the second hook-and-loop fastener strip 27 or second hook-and-loop fastener strip 27'. Attaching the first half 22 of the closing arrangement comprising the first zipper strip 26 and the first hook-and-loop fastener strip 25 to the second zipper 28 and the second hook-and-loop fastener strip 27 results in a larger diameter tubular leg 24, whereas, attachment of the first zipper strip 28' and second zipper strip 28' results in smaller tubular leg 24.

When the vertical edges 16 and 17 of the leg panel 15 are connected, the first hook-and-loop fastener strip 27 or 27', the corresponding zipper halves 26 and 28 or 28' are completely covered and enclosed. This is an important feature in snow or icy conditions, as well as muddy conditions, to keep the zippers from freezing up and becoming difficult to open or close.

Although different types of fasteners may be used such as a zip-lock fastener for either the zipper or the hook-and-loop fastener, these are clearly inferior and do not provide the versatility and utility of the present invention combining zippers with hook-and-loop fasteners. The features of the present invention may also be applied to so-called "gators" or sometimes referred to as "gaiters" where separate leg assemblies are worn like conventional hip boots.

In the preferred embodiment of this invention, the inside surface 18 of the leg panel 15 is covered with a thin polyester fibric 30. The space between the inside surface 18 of the leg panel and the thin polyester fabric 30 is filled with a chainsaw cut protective layer 32 of polyester/aramid fiber (or similar protective layer) and, in order to provide dual protection against chainsaw cuts and snake bites, the inside surface of the leg panel may be provided with a snake bite protective layer 31 comprising a suitable woven material. The optional snake bite protective layer need not extend the full height of the leg panel, but rather only about 12"-16" thereby defining the region more likely to be susceptible to snake bites. Preferably, the chainsaw protective material is used to fill narrow portions of the leg assemblies 11 such as the thin region between the first hook-and-loop fastener strip 25 and the first zipper strip 26. Similarly, the narrow layer between the second zippers 28, 28' may be filled with chainsaw protective material.

What is claimed is:

1. A protective leg chap comprising:

a pair of leg assemblies each having an outer cloth shell;

each leg assembly including a leg panel of generally rectangular shape defined by opposite substantially parallel edges when the leg panel is open and flat;

an open-and-close arrangement extending substantially the full length of the vertical edges and defining a tubular leg when the leg panel edges are overlapped and connected;

the open-and-close arrangement comprising a first closure half extending along one panel edge, the first closure half defined by a first half of one type of fastener and a first half of a different type of fastener; and a second closure half extending along the other panel edge, the second closure half defined by a second half of said one type of fastener and a second half of said different type of a fastener; and the first and second halves of said one type of fastener are coextensive, and the first and second halves of said different type of fastener are coextensive and positioned such that, when said one type of fastener is closed, the first half of said different type of fastener is attachable to the second half of said different type of fastener and covers and encloses said one type of fastener.

2. The leg chap as set forth in claim 1, wherein said one type of fastener is a zipper.

3. The leg chap as set forth in claim 2, wherein said different type of fastener is a hook-and-loop fastener.

4. The leg chap as set forth in claim 1, wherein the first halves of said one type of fastener and said different type of fastener comprise a pair of parallel strips, and the second halves of said one type of fastener and said different type of fastener comprise a second pair of parallel strips.

5. The leg chap as set forth in claim 4, wherein said one type of fastener is a zipper and said different type of fastener is a hook-and-loop fastener.

6. The protective leg chap as set forth in claim 1, wherein the shells are connected to one another by an upper rear support section.

7. A protective leg chap comprising:

a pair of leg assemblies each having an outer cloth shell, the shells connected to one another by an upper rear support section;

each leg assembly including a leg panel of generally rectangular shape defined in part by opposite substantially parallel edges when the leg panel is open and flat;

a closing arrangement extending substantially the full length of the edges and defining a tubular leg, when the leg panel edges are overlapped and closed;

the closing arrangement comprising a first closure half extending along substantially all of one panel edge and comprising a first half of a zipper and a first half of a hook-and-loop fastener, and a second closure half extending along substantially all of said one panel edge and comprising a second half of said zipper and a second half of said hook-and-loop fastener; and the first and second halves of said zipper and the first and second halves of said hook-and-loop fastener positioned such that, when said zipper is closed, the first half of said hook-and-loop fastener covers and encloses said zipper.

8. The leg chap as set forth in claim 7, wherein the first half of the zipper and the first half of the hook-and-loop fastener are positioned on the inside of one of the leg panels, and the second half of the zipper and the second half of the hook-and-loop fastener are positioned on the outside of the leg panel when the panel edges are overlapped.

9. The leg chap as set forth in claim 8, wherein the second closure half comprises a pair of parallel spaced zipper strips and a pair of parallel spaced hook-and-loop fastener strips.

10. The leg chap as set forth in claim 9, wherein respective pairs of a second zipper strip and a second hook-and-loop fastener strip are selectively attachable to the first halves of the zipper and the hook-and-loop fastener on said one panel edge.

11. The leg chap as set forth in claim 7, wherein the outer cloth shell is covered on an inside surface with a thin polyester fabric.

12. The leg chap as set forth in claim 11, wherein a chainsaw protective layer of polyester/aramid fiber is disposed between the shell and the polyester fabric.

13. The leg chap as set forth in claim 12, wherein a lower portion of the inside surface of the leg panel is provided with a snake bite protective layer.

14. The leg chap as set forth in claim 13, wherein the snake bite protective layer comprises a woven material.

15. A protective leg chap comprising:

a leg assembly having an outer cloth shell;

the leg assembly including a leg panel of generally rectangular shape defined by opposite substantially parallel edges when the leg panel is open and flat;

an open-and-close arrangement extending substantially the full length of the leg panel edges and defining a tubular leg when the leg panel edges are overlapped, connected and closed;

the open-and-close arrangement comprising a first closure half extending along, substantially all of one panel edge, the first closure half including a first half of a zipper and a first half of a hook-and-loop fastener; and a second closure half extending along the other panel edge, the second closure half including a second half of said zipper and a second half of said hook-and-loop fastener; and the first and second halves of said zipper and the first and second halves of said hook-and-loop fastener positioned such that, when said zipper is closed, the first half of said hook-and-loop fastener attaches to the second half of said hook-and-loop fastener and covers the full of said zipper.

16. The leg chap as set forth in claim 15, comprising a pair of leg assemblies connected to one another by an upper support section.

17. The leg chap as set forth in claim 15, wherein overlying layers of a chainsaw protective material and a snake bite protective material are applied to an inside surface of the outer shell.

* * * * *